US011140496B2

(12) United States Patent
Xue et al.

(10) Patent No.: US 11,140,496 B2
(45) Date of Patent: Oct. 5, 2021

(54) EAR-WORN ELECTRONIC DEVICE INCORPORATING AN INTEGRATED BATTERY/ANTENNA MODULE

(71) Applicant: Starkey Laboratories, Inc., Eden Prairie, MN (US)

(72) Inventors: Dong Xue, Bloomington, MN (US); Zhenchao Yang, Eden Prairie, MN (US); Tim Wilburn, Mendota Heights, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 0 days.

(21) Appl. No.: 16/285,667

(22) Filed: Feb. 26, 2019

(65) Prior Publication Data

US 2020/0275218 A1 Aug. 27, 2020

(51) Int. Cl.

| | |
|---|---|
| ***H04R 25/00*** | (2006.01) |
| ***H01Q 1/27*** | (2006.01) |
| ***H01Q 1/36*** | (2006.01) |
| ***H01Q 1/48*** | (2006.01) |

(52) U.S. Cl.

CPC ..... *H04R 25/554* (2013.01); *H01Q 1/273* (2013.01); *H01Q 1/362* (2013.01); *H01Q 1/48* (2013.01); *H04R 25/602* (2013.01); *H04R 25/604* (2013.01); *H04R 2225/023* (2013.01); *H04R 2225/025* (2013.01); *H04R 2225/51* (2013.01)

(58) Field of Classification Search

CPC ..... H01Q 1/273; H01Q 1/362; H01Q 1/48; H04R 1/1025; H04R 2225/023; H04R 2225/025; H04R 2225/31; H04R 2225/51; H04R 25/554; H04R 25/602; H04R 25/604

USPC ..... 381/315

See application file for complete search history.

(56) References Cited

U.S. PATENT DOCUMENTS

| | | | | |
|---|---|---|---|---|
| 6,229,499 | B1 | 5/2001 | Licul et al. | |
| 7,292,203 | B2 | 11/2007 | Craggs et al. | |
| 7,742,614 | B2 * | 6/2010 | Christensen | H01Q 1/273 381/324 |
| 8,259,026 | B2 | 9/2012 | Pulimi et al. | |
| 8,934,984 | B2 | 1/2015 | Meskens et al. | |
| 9,444,148 | B2 | 9/2016 | Shashi et al. | |
| 9,561,361 | B2 | 2/2017 | Thenuwara et al. | |

(Continued)

OTHER PUBLICATIONS

Ruaro et al., "Wearble Shell Antenna for 2.4 GHz Hearing Instruments", IEEE Transactions on Antennas and Propagation, 9 pages.

(Continued)

*Primary Examiner* — Phylesha Dabney

(74) *Attorney, Agent, or Firm* — Mueting Raasch Group

(57) ABSTRACT

An ear-worn electronic device is configured to be worn by a wearer and comprises a housing configured to be supported at, by, in or on the wearer's ear. A processor is disposed in the housing, and a speaker or a receiver is operably coupled to the processor. A radio frequency transceiver is disposed in the housing and operably coupled to the processor. A battery/antenna module is disposed in the housing and comprises a battery, a helical antenna wrapped around the battery, and electrically insulating material disposed between the helical antenna and the battery. The helical antenna is operably coupled to the transceiver.

23 Claims, 9 Drawing Sheets

(56) References Cited

U.S. PATENT DOCUMENTS

| | | | | |
|---|---|---|---|---|
| 9,866,282 | B2 | 1/2018 | Hirsch et al. | |
| 9,972,895 | B2 * | 5/2018 | Hirsch | H01Q 1/2291 |
| 10,009,697 | B2 | 6/2018 | Henriksen et al. | |
| 10,051,388 | B2 | 8/2018 | Polinske et al. | |
| 2006/0227989 | A1 | 10/2006 | Polinske | |
| 2010/0202639 | A1 | 8/2010 | Christensen et al. | |
| 2013/0328524 | A1 * | 12/2013 | Bartulec | H02J 50/00 320/108 |
| 2015/0131831 | A1 * | 5/2015 | Akdeniz | H04R 25/554 381/315 |
| 2017/0070829 | A1 | 3/2017 | Polinske | |
| 2017/0150278 | A1 | 5/2017 | Ruaro | |
| 2017/0202467 | A1 | 7/2017 | Zitnik et al. | |
| 2018/0014104 | A1 * | 1/2018 | Boesen | H04R 1/1025 |
| 2018/0138583 | A1 | 5/2018 | Yang et al. | |
| 2020/0028246 | A1 | 1/2020 | Kim | |

OTHER PUBLICATIONS

Ruaro et al., "Rapid Prototyping of an Electrically-Small Antenna for Binaural-Hearing Instruments", ISAP 2015, 4 pages.

Xue et al., "Electrically-Small Folded Cylindrical Helix Antenna for Wireless Body Area Networks", 2016 Texas Symposium on Wireless and Microwave Circuits and Systems (WMCS), 2016, 4 pages.

Xue et al., "On-Body Radiation of 3D-Printed Fold Cylindrical Helix (FCH) Wearable Antenna", IEEE, 2017, 4 pages.

Djordjevic et al., "Enhancing the Gain of Helical Antennas by Shaping the Ground Conductor", IEEE Antennas and Wireless Propagation Letters, vol. 5, No. 1, Dec. 2006, pp. 138-140.

European Search Report from EP Application No. 20159556.8 dated Oct. 16, 2020, 12 pages.

* cited by examiner

EAR-WORN ELECTRONIC DEVICE INCORPORATING AN INTEGRATED BATTERY/ANTENNA MODULE

TECHNICAL FIELD

This application relates generally to ear-worn electronic devices, including hearing devices, hearing aids, personal amplification devices, and other hearables.

BACKGROUND

Hearing devices provide sound for the wearer. Some examples of hearing devices are headsets, hearing aids, speakers, cochlear implants, bone conduction devices, and personal listening devices. For example, hearing aids provide amplification to compensate for hearing loss by transmitting amplified sounds to a wearer's ear canals. Hearing devices may be capable of performing wireless communication with other devices, such as receiving streaming audio from a streaming device via a wireless link. Wireless communication may also be performed for programming the hearing device and transmitting information from the hearing device. For performing such wireless communication, hearing devices such as hearing aids can include a wireless transceiver and an antenna.

SUMMARY

Embodiments are directed to an ear-worn electronic device configured to be worn by a wearer and comprising a housing configured to be supported at, by, in or on the wearer's ear. A processor is disposed in the housing, and a speaker or a receiver is operably coupled to the processor. A radio frequency transceiver is disposed in the housing and operably coupled to the processor. A battery/antenna module is disposed in the housing and comprises a battery, a helical antenna wrapped around the battery, and electrically insulating material disposed between the helical antenna and the battery. The helical antenna is operably coupled to the transceiver.

Embodiments are directed to an ear-worn electronic device configured to be worn by a wearer and comprising a housing configured to be supported at, by, in or on the wearer's ear. A processor is disposed in the housing, and a speaker or a receiver is operably coupled to the processor. A radio frequency transceiver is disposed in the housing and operably coupled to the processor. A battery/antenna module is disposed in the housing and comprises a battery, a helical antenna comprising a plurality of wires wrapped around the battery, and an electrically insulating cap disposed on the battery. The cap separates the wires from the battery and comprises a support arrangement configured support the wires in a fixed position relative to the battery. The helical antenna is operably coupled to the transceiver.

Embodiments are directed to an ear-worn electronic device configured to be worn by a wearer and comprising a housing configured for at least partial insertion into an ear canal of the wearer. The housing has a preformed shape that conforms to a shape of the wearer's ear canal. A processor is disposed in the housing, and a speaker or a receiver is operably coupled to the processor. A radio frequency transceiver is disposed in the housing and operably coupled to the processor. A battery/antenna module is disposed in the housing and comprises a battery, a helical antenna wrapped around the battery, and electrically insulating material disposed between the helical antenna and the battery. The helical antenna is operably coupled to the transceiver.

Embodiments are directed to a battery/antenna module for use in a body-worn electronic device or other electronic device. The battery/antenna module comprises a battery, a helical antenna wrapped around the battery, and electrically insulating material disposed between the helical antenna and the battery. In some embodiments, the battery/antenna module can be configured for fixed or permanent installation (e.g., non-removable/non-replaceable) in a body-worn electronic device or other electronic device, in which case the battery can be a rechargeable battery. In other embodiments, the battery/antenna module can be a replaceable component (removable) for installation in and removal from (e.g., by a user or technician) a body-worn electronic device or other electronic device, in which case the battery can be a conventional, non-rechargeable battery, but can alternatively be a rechargeable battery.

The above summary is not intended to describe each disclosed embodiment or every implementation of the present disclosure. The figures and the detailed description below more particularly exemplify illustrative embodiments.

BRIEF DESCRIPTION OF THE DRAWINGS

Throughout the specification reference is made to the appended drawings wherein.

The figures are not necessarily to scale. Like numbers used in the figures refer to like components. However, it will be understood that the use of a number to refer to a component in a given figure is not intended to limit the component in another figure labeled with the same number.

DETAILED DESCRIPTION

Figure 1A:
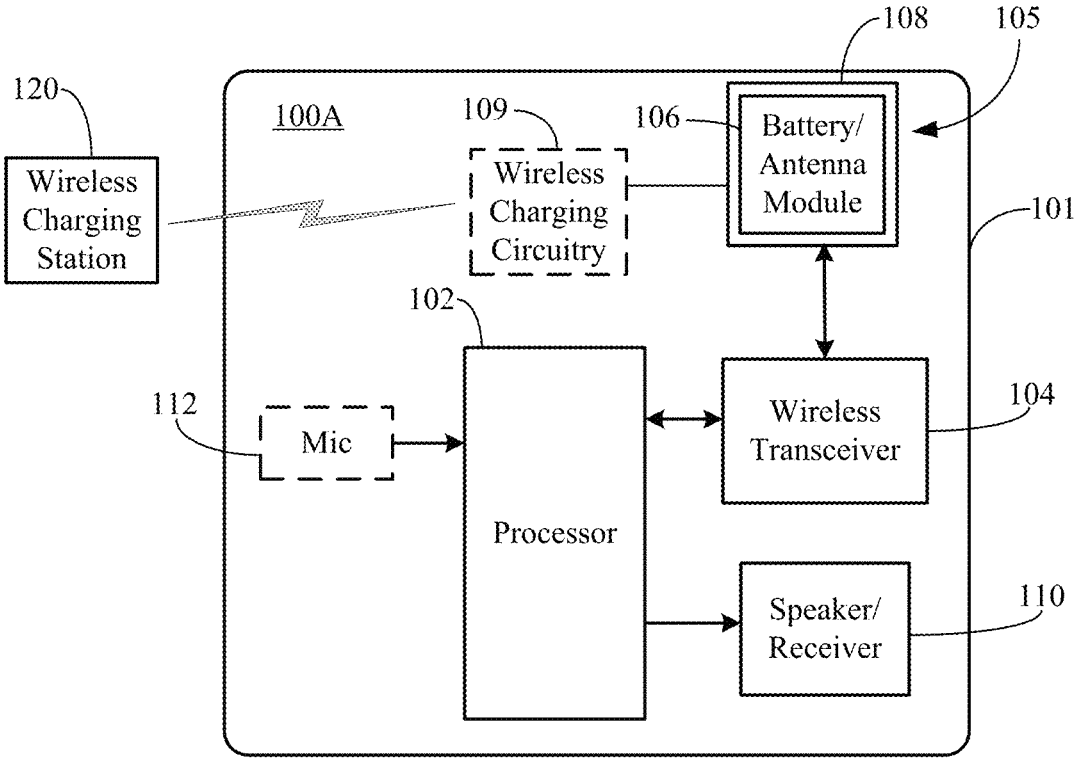
FIGS. 1A and 1B illustrate an ear-worn electronic device arrangement which incorporates an integrated battery/antenna module in accordance with any of the embodiments disclosed herein.

It is understood that the embodiments described herein may be used with any ear-worn or ear-level electronic device without departing from the scope of this disclosure. The devices depicted in the figures are intended to demonstrate the subject matter, but not in a limited, exhaustive, or exclusive sense. Ear-worn electronic devices (also referred to herein as "hearing devices"), such as hearables (e.g., wearable earphones, ear monitors, and earbuds), hearing aids, hearing instruments, and hearing assistance devices, typically include an enclosure, such as a housing or shell, within which internal components are disposed. Typical components of a hearing device according to various embodiments can include a processor (e.g., a digital signal processor or DSP), memory circuitry, power management circuitry, one or more communication devices (e.g., a radio, a near-field magnetic induction (NFMI) device), one or more microphones, and a receiver or speaker, for example. Hearing device embodiments of the disclosure include an integrated battery/antenna module, which can be implemented as a hardwired battery/antenna module incorporating a rechargeable battery. Alternatively, the battery/antenna module can be removable from the hearing device, and include a conventional or rechargeable battery. The battery of the battery/antenna module is coupled to power management circuitry of the hearing device, and the antenna is coupled to a radio or other wireless communication device of the hearing device. Hearing devices can incorporate a long-range communication device, for example, such as a Bluetooth® transceiver or other type of radio frequency (RF) transceiver. A communication device (e.g., a radio or NFMI device) of a hearing device can be configured to facilitate communication between a left ear device and a right ear device of the hearing device.

Hearing devices of the present disclosure can incorporate an integrated battery/antenna module wherein the antenna is coupled to a high-frequency transceiver, such as a 2.4 GHz radio. The RF transceiver can conform to an IEEE 802.11 (e.g., WiFi®) or Bluetooth® (e.g., BLE, Bluetooth® 4. 2 or 5.0) specification, for example. It is understood that hearing devices of the present disclosure can employ other transceivers or radios, such as a 900 MHz radio.

Hearing devices of the present disclosure can be configured to receive streaming audio (e.g., digital audio data or files) from an electronic or digital source. Representative electronic/digital sources (e.g., accessory devices) include an assistive listening system, a TV streamer, a radio, a smartphone, a laptop, a cell phone/entertainment device (CPED) or other electronic device that serves as a source of digital audio data or other types of data files. Hearing devices of the present disclosure can be configured to effect bi-directional communication (e.g., wireless communication) of data with an external source, such as a remote server via the Internet or other communication infrastructure. Hearing devices that include a left ear device and a right ear device can be configured to effect bi-directional communication (e.g., wireless communication) therebetween, so as to implement ear-to-ear communication between the left and right ear devices.

The term hearing device of the present disclosure refers to a wide variety of ear-level electronic devices that can aid a person with impaired hearing. The term hearing device also refers to a wide variety of devices that can produce processed sound for persons with normal hearing. Hearing devices of the present disclosure include hearables (e.g., wearable earphones, headphones, earbuds, virtual reality headsets), hearing aids (e.g., hearing instruments), cochlear implants, and bone-conduction devices, for example. Hearing devices include, but are not limited to, behind-the-ear (BTE), in-the-ear (ITE), in-the-canal (ITC), invisible-in-canal (IIC), receiver-in-canal (RIC), receiver-in-the-ear (RITE) or completely-in-the-canal (CIC) type hearing devices or some combination of the above. Throughout this disclosure, reference is made to a "hearing device," which is understood to refer to a system comprising a single left ear device, a single right ear device, or a combination of a left ear device and a right ear device.

Ear-worn electronic devices configured for wireless communication, such as hearing aids and other types of hearing devices, are relatively small in size. Custom hearing devices, such as ITE, ITC, and CIC devices for example, are quite small in size. In the manufacture of a custom hearing device, for example, an ear impression or ear mold is taken for a particular wearer and processed to construct the housing of the hearing device. Because custom hearing devices are designed to be partially or fully inserted into a wearer's ear canal, the housing is necessarily quite small. In order to implement a functional wireless platform (e.g., @ 2.4 GHz), the antenna must be small enough to fit within such devices while at the same time providing adequate antennal performance.

The severe space limitations within the housing of custom and other small hearing devices impose a physical challenge on designing the antenna. One approach to address this challenge is to install a conventional antenna, such as a loop, patch, or bowtie antenna, within the housing of the custom or small hearing device. For relatively small conventional antennas, including those that approach the electrically small antenna theoretical limit, such antennas typically have poor impedance matching, very narrow bandwidth, and low radiation efficiency. There is a trade-off between bandwidth and radiation efficiency. If the bandwidth improves, then the radiation efficiency drops. It is a challenge to design an antenna for custom and small hearing devices which has a wide bandwidth and good radiation efficiency given constraints imposed by limited housing space. Previous attempts to solve this challenge for custom and other small 2.4 GHz hearing devices, for example, often suffer from unacceptably low antenna efficiency and insufficient bandwidth due to the restriction in antenna size.

Embodiments of the disclosure are directed to an integrated battery/antenna module which is space-efficient and provides good radiation efficiency and a wide bandwidth. A battery/antenna module according to various embodiments embeds the battery inside the antenna, such that the total size of the battery/antenna module is about the same as the size (e.g., within 2-10%) of the battery. An integrated battery/antenna module according to various embodiments is particularly well suited for use within custom and small hearing devices. For relatively large hearing devices, an integrated battery/antenna module according to various embodiments provides a space-savings solution that reduces the housing volume requirement for accommodating the antenna.

According to some embodiments, an integrated battery/antenna module is implemented in accordance with electrically small antenna theory. Given a specified volume (e.g., a volume approximating that of the battery) within a custom or other small hearing device, the antenna of the battery/antenna module can be implemented to provide maximum bandwidth and radiation efficiency. In some embodiments, the antenna of the battery/antenna module can be self-resonant, which requires minimal or no matching effort (e.g., simplifies or eliminates a matching network). For embodiments implemented for operation within a 2.4 GHz ISM frequency band, the antenna of the battery/antenna module has a relative wide bandwidth which can satisfy the entire Bluetooth® frequency range. In various embodiments, the antenna of the battery/antenna module is vertically polarized, which provides for reliable ear-to-ear communication over the Bluetooth® frequency band, since the vertically polarized antenna efficiently couples with human body creeping waves. Evaluation of a prototype battery/antenna module demonstrated an improvement in antenna radiation efficiency of about 4 dB compared to a conventional patch antenna. The prototype battery/antenna module also demonstrated a total radiated power that was comparable to that of a conventional tuned patch antenna.

Figure 1B:
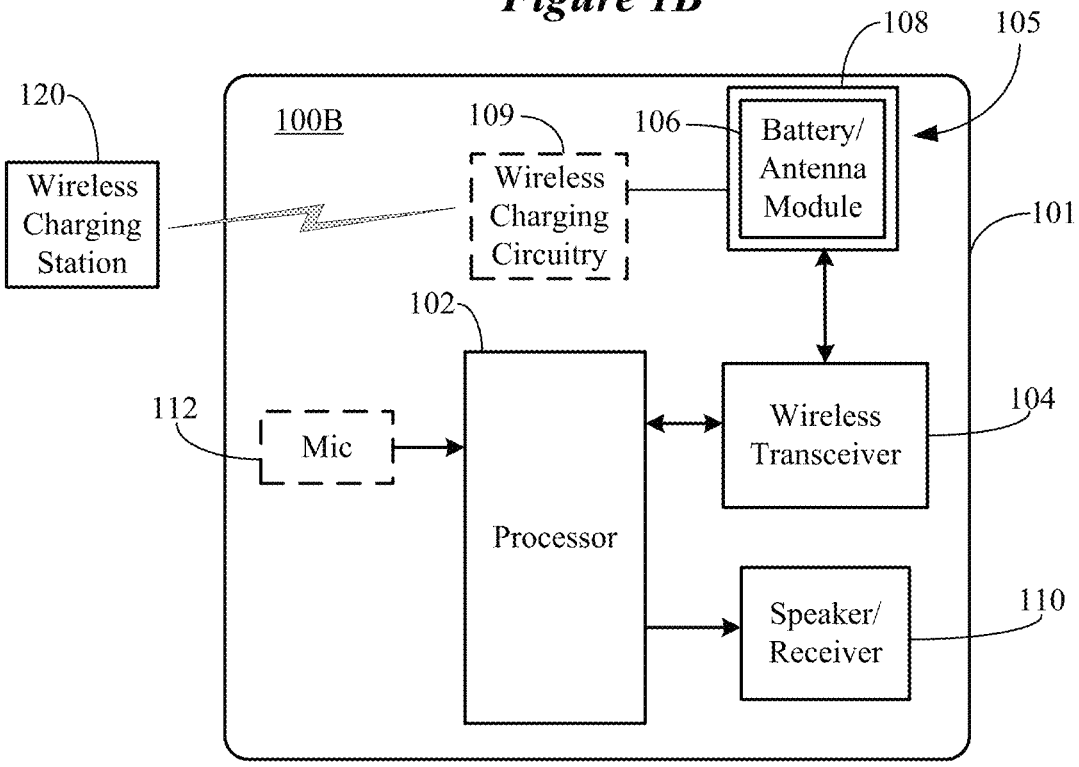

FIGS. 1A and 1B illustrate various components of a representative hearing device arrangement in accordance with any of the embodiments disclosed herein. FIGS. 1A and 1B illustrate first and second hearing devices 100A and 100B configured to be supported at, by, in or on left and right ears of a wearer. In some embodiments, a single hearing device 100A or 100B can be supported at, by, in or on the left or right ear of a wearer. As illustrated, the first and second hearing devices 100A and 100B include the same functional components. It is understood that the first and second hearing devices 100A and 100B can include different functional components. The first and second hearing devices 100A and 100B can be representative of any of the hearing devices disclosed herein.

The first and second hearing devices 100A and 100B include an enclosure 101 configured for placement, for example, over or on the ear, entirely or partially within the external ear canal (e.g., between the pinna and ear drum) or behind the ear. Disposed within the enclosure 101 is a processor 102 which incorporates or is coupled to memory circuitry. The processor 102 can include or be implemented as a multi-core processor, a digital signal processor (DSP), an audio processor or a combination of these processors. For example, the processor 102 may be implemented in a variety of different ways, such as with a mixture of discrete analog and digital components that include a processor configured to execute programmed instructions contained in a processor-readable storage medium (e.g., solid-state memory, e.g., Flash). A speaker or receiver 110 is coupled to an amplifier (not shown) and the processor 102. The speaker or receiver 110 is configured to generate sound which is communicated to the wearer's ear.

An integrated battery/antenna module 105 is included within the enclosure 101. The battery/antenna module 105 comprises a battery 106 encompassed by an antenna 108. The battery 106 is coupled to power management circuitry and provides power to the various components of the hearing devices 100A and 100B. The battery 106 is preferably a rechargeable battery, such as a lithium-ion battery or a lithium polymer battery. Other battery technologies are contemplated. In some embodiments, the battery 106 can be implemented as a rechargeable supercapacitor power source, which incorporates one or more supercapacitors (e.g., coaxial fiber supercapacitors).

In accordance with some embodiments, the electronics of the hearing devices 100A and 100B can incorporate wireless charging circuitry 109. The wireless charging circuitry 109 is configured to cooperate with an external wireless charging station 120 to wirelessly charge the battery 106 of the battery/antenna module 105. According to some embodiments, the wireless charging station 120 uses an induction coil to create an alternating electromagnetic field which is transmitted to the wireless charging circuitry 109 within the enclosure 101. In response to the electromagnetic field, current is induced in an induction coil within the wireless charging circuitry 109 which charges the battery 106. According to some embodiments, the wireless charging circuitry 109 and wireless charging station 120 are configured to implement inductive charging in accordance with the Qi open interface standard developed by the Wireless Power Consortium.

The processor 102 is coupled to a wireless transceiver 104 (also referred to herein as a radio), such as a BLE transceiver. The wireless transceiver 104 is operably coupled to the antenna 108 of the battery/antenna module 105 and configured for transmitting and receiving radio signals. The wireless transceiver 104 and antenna 108 can be configured to enable ear-to-ear communication between the two hearing devices 100A and 100B, as well as communications with an external device (e.g., a smartphone or a digital music player). As was discussed previously, the antenna 108 is preferably vertically polarized, which provides for reliable ear-to-ear communication since the vertically polarized antenna 108 efficiently couples with creeping waves.

In accordance with any of the embodiments disclosed herein, the antenna 108 is implemented as a helical antenna. In some embodiments, the battery 106 has a metal (e.g., stainless steel) exterior, and an electrically insulating material is disposed between the battery 106 and the antenna 108. In other embodiments, the battery 106 is encased or otherwise sealed within plastic or other electrically insulating material. For example, the battery 106 can be a rechargeable battery (e.g., lithium-ion cell), and the encasement material provided over the battery 106 protects against battery leakage. The antenna 108 may include or exclude a protective coating, such as an electrically insulating material (e.g., polyimide).

According to various embodiments, the electrically insulating material disposed on, covering, or encapsulating the battery 106 provides support for the antenna 108. For example, the material covering the battery 106 can include a support arrangement (e.g., a thread, channel or groove arrangement) configured to support the antenna 108 on the battery 106. In some embodiments, the antenna 108 is implemented as a flexible printed wire antenna which is affixed (e.g., via an adhesive) to the battery 106. In such embodiments, and electrically insulating layer (e.g., polyimide) of the flexible printed wire antenna serves as an electrical insulator between the antenna 108 and the battery 106. Wrapping the helical antenna 108 around the battery 106 to form an integrated battery/antenna module 105 makes the antenna 108 much more robust and stable compared to conventional wire and flexible antennas incorporated in a hearing device. The integrated battery/antenna configuration mitigates unexpected coupling effects with other metal components of the hearing device, and reduces the degree of uncertainty during the assembly.

In some embodiments, the hearing devices 100A and 100B include a microphone 112 mounted on or inside the enclosure 101. The microphone 112 may be a single microphone or multiple microphones, such as a microphone array. The microphone 112 can be coupled to a preamplifier (not shown), the output of which is coupled to the processor 102.

The microphone 112 receives sound waves from the environment and converts the sound into an input signal. The input signal is amplified by the preamplifier and sampled and digitized by an analog-to-digital converter of the processor 102, resulting in a digitized input signal. In some embodiments (e.g., hearing aids), the processor 102 (e.g., DSP circuitry) is configured to process the digitized input signal into an output signal in a manner that compensates for the wearer's hearing loss. When receiving an audio signal from an external source, the wireless transceiver 104 may produce a second input signal for the DSP circuitry of the processor 102 that may be combined with the input signal produced by the microphone 112 or used in place thereof. In other embodiments, (e.g., hearables), the processor 102 can be configured to process the digitized input signal into an output signal in a manner that is tailored or optimized for the wearer (e.g., based on wearer preferences). The output signal is then passed to an audio output stage that drives the speaker or receiver 110, which converts the output signal into an audio output.

Some embodiments are directed to a custom hearing aid, such as an ITC, CIC, or IIC hearing aid. For example, some embodiments are directed to a custom hearing aid which includes a wireless transceiver and an antenna arrangement configured to operate in the 2.4 GHz ISM frequency band or other applicable communication band (referred to as the "Bluetooth® band" herein). As was discussed previously, creating a robust antenna arrangement for a 2.4 GHz custom hearing aid represents a significant engineering challenge. A custom hearing aid is severely limited in space, and the antenna arrangement is in close proximity to other electrical components, both of which impacts antenna performance. Because the human body is very lossy and a custom hearing aid is positioned within the ear canal, a high performance antenna 108 (e.g., high antenna radiation efficiency and/or wide bandwidth) is particularly desirable. Embodiments of the disclosure are directed to an integrated battery/antenna module having a compact form factor and which incorporates a high performance helical antenna.

Figure 2A:
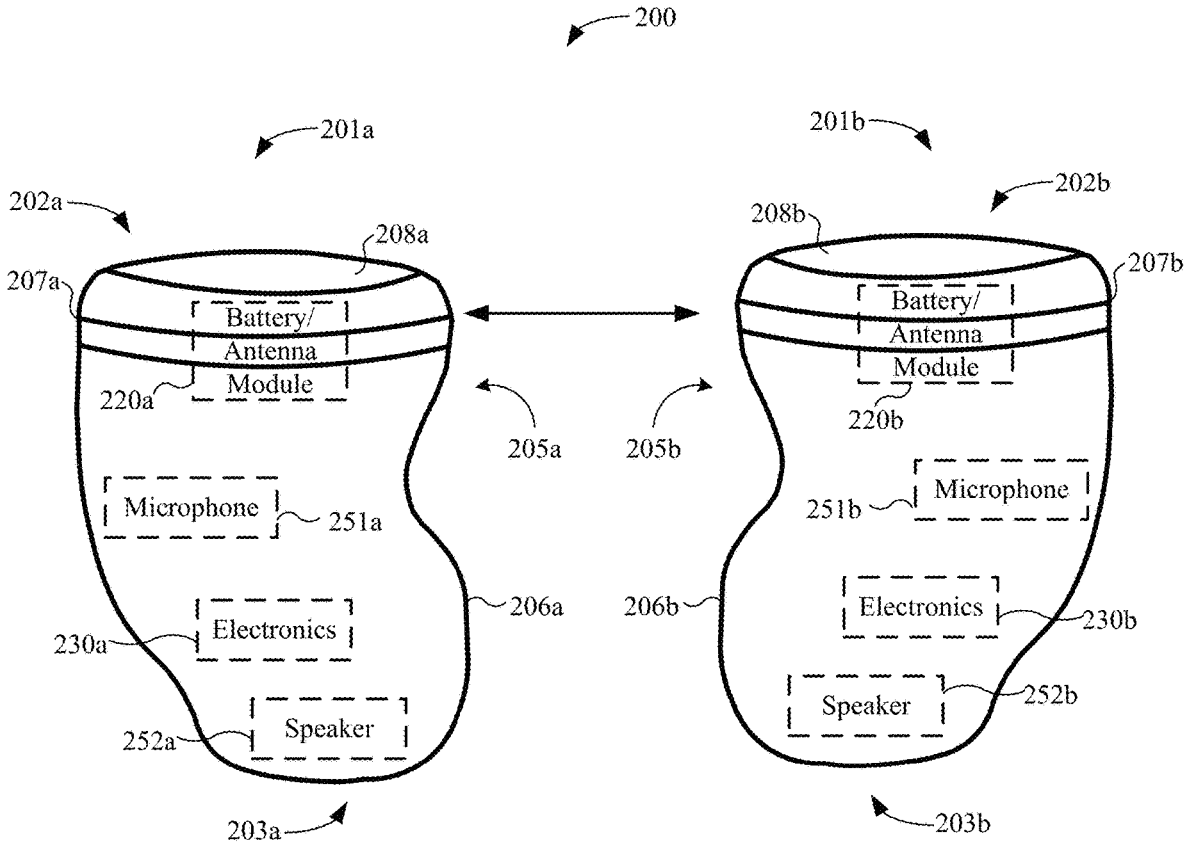
FIGS. 2A and 2B illustrate a custom hearing device system which incorporates an integrated battery/antenna module in accordance with any of the embodiments disclosed herein.
Figure 2B:
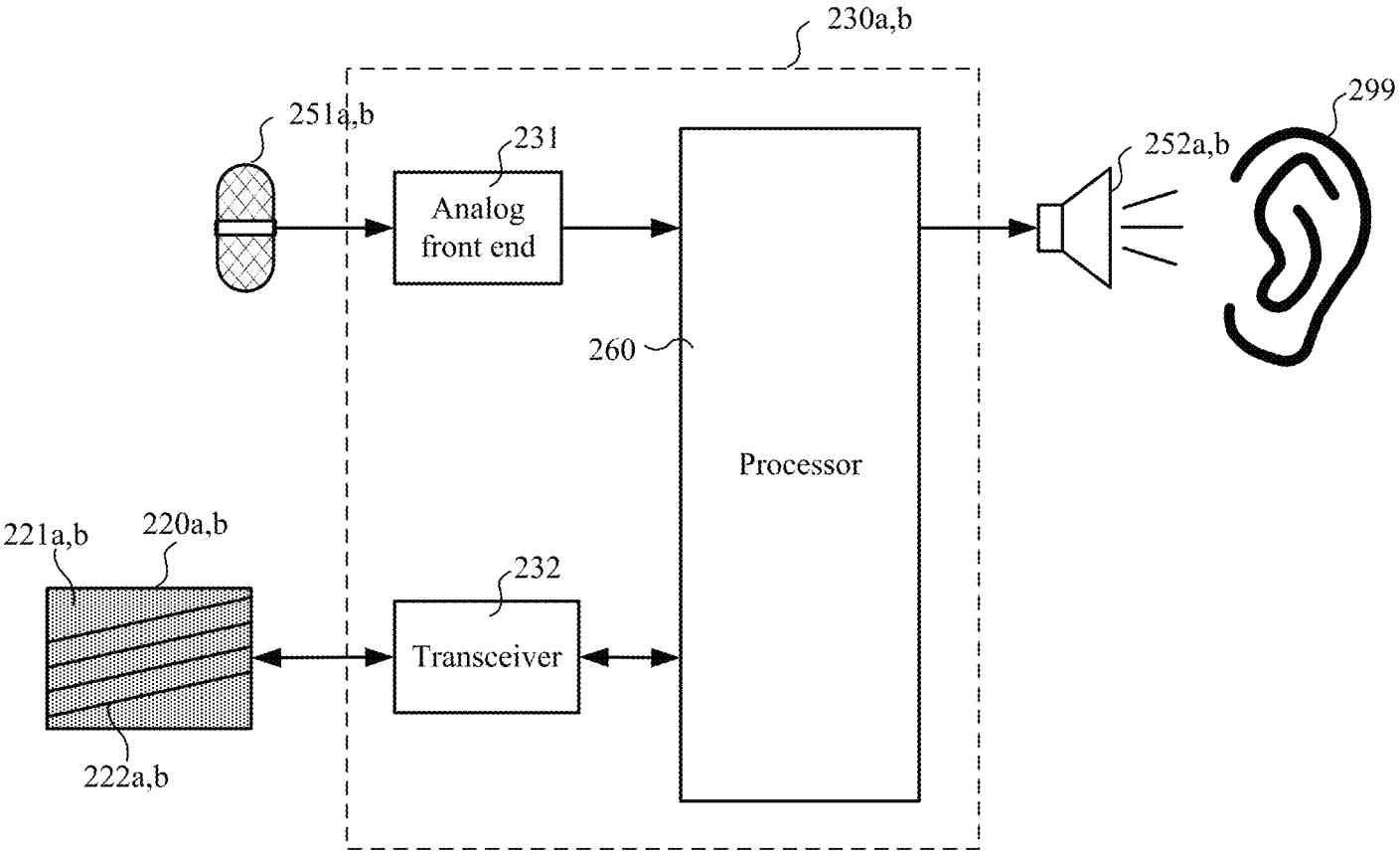

FIGS. 2A and 2B illustrate a custom hearing aid system which incorporates an integrated battery/antenna module in accordance with any of the embodiments disclosed herein. The hearing aid system 200 shown in FIGS. 2A and 2B includes two hearing devices, e.g., left 201*a* and right 201*b* side hearing devices, configured to wirelessly communicate with each other and external devices and systems. FIG. 2A conceptually illustrates functional blocks of the hearing devices 201*a*, 201*b*. The position of the functional blocks in FIG. 2A does not necessarily indicate actual locations of components that implement these functional blocks within the hearing devices 201*a*, 201*b*. FIG. 2B is a block diagram of components that may be disposed in and/or at least partially within the enclosure 205*a*, 205*b* of the hearing device 201*a*, 201*b*.

Each hearing device 201*a*, 201*b* includes a physical enclosure 205*a*, 205*b* that encloses an internal volume. The enclosure 205*a*, 205*b* is configured for at least partial insertion within the wearer's ear canal. The enclosure 205*a*, 205*b* includes an external side 202*a*, 202*b* that faces away from the wearer and an internal side 203*a*, 203*b* that is inserted in the ear canal. The enclosure 205*a*, 205*b* comprises a shell 206*a*, 206*b* and can include a faceplate 207*a*, 207*b*. The shell 206*a*, 206*b* typically has a shape that is customized to the shape of a particular wearer's ear canal.

A battery/antenna module 220*a*, 220*b* is disposed within the shell 206*a*, 206*b*. As is shown in FIG. 2B, the battery/antenna module 220*a*, 220*b* comprises an antenna 222*a*, 222*b* that partially or completely encompasses a battery 221*a*, 221*b*. As is shown in other figures, the battery/antenna module 220*a*, 220*b* can also comprise electrically insulating material disposed between the antenna 222*a*, 222*b* and the battery 221*a*, 221*b*. According to various embodiments, the antenna 222*a*, 222*b* is wrapped around the battery 221*a*, 221*b* to define a highly compact and space-efficient component of the hearing device 201*a*, 201*b*. In some embodiments, the battery/antenna module 220*a*, 220*b* is mounted on the faceplate 207*a*, 207*b*. In embodiments in which the battery/antenna module 220*a*, 220*b* is implemented as a non-removable component of the hearing device 201*a*, 201*b*, the battery 221*a*, 221*b* is a rechargeable battery. In other embodiments, the faceplate 207*a*, 207*b* may include a door 208*a*, 208*b* or drawer disposed near the external side 202*a*, 202*b* of the enclosure 205*a*, 205*b* and configured to allow the battery/antenna module 220*a*, 220*b* to be inserted into and removed from the enclosure 205*a*, 205*b*. In embodiments in which the battery/antenna module 220*a*, 220*b* is implemented as a removable component of the hearing device 201*a*, 201*b*, the battery 221*a*, 221*b* is typically a conventional battery (e.g., non-rechargeable), but may alternatively be a rechargeable battery.

The battery 221*a*, 221*b* of the battery/antenna module 220*a*, 220*b* powers electronic circuitry 230*a*, 230*b* which is also disposed within the shell 206*a*, 206*b*. As illustrated in FIGS. 2A and 2B, the hearing device 201*a*, 201*b* may include one or more microphones 251*a*, 251*b* configured to pick up acoustic signals and to transduce the acoustic signals into microphone electrical signals. The electrical signals generated by the microphones 251*a*, 251*b* may be conditioned by an analog front end 231 (see FIG. 2B) by filtering, amplifying and/or converting the microphone electrical signals from analog to digital signals so that the digital signals can be further processed and/or analyzed by the processor 260. The processor 260 may perform signal processing and/or control various tasks of the hearing device 201*a*, 201*b*. In some implementations, the processor 260 comprises a DSP that may include additional computational processing units operating in a multi-core architecture.

The processor 260 is configured to control wireless communication between the hearing devices 201*a*, 201*b* and/or an external accessory device (e.g., a smartphone, a digital music player) via the antenna 222*a*, 222*b*. The wireless communication may include, for example, audio streaming data and/or control signals. The electronic circuitry 230*a*, 230*b* of the hearing device 201*a*, 201*b* includes a transceiver 232 operably coupled to the antenna 222*a*, 222*b*. In some embodiments, a matching network is coupled between the antenna 222*a*, 222*b* and the transceiver 232. In other embodiments, the antenna 222*a*, 222*b* is configured as a self-resonant antenna, in which case no matching network or only a simplified matching network is needed.

The transceiver 232 has a receiver portion that receives communication signals from the antenna 222*a*, 222*b*, demodulates the communication signals, and transfers the signals to the processor 260 for further processing. The transceiver 232 also includes a transmitter portion that modulates output signals from the processor 260 for transmission via the antenna 222*a*, 222*b*. Electrical signals from the microphone 251*a*, 251*b* and/or wireless communication received via the antenna 222*a*, 222*b* may be processed by the processor 260 and converted to acoustic signals played to the wearer's ear 299 via a speaker or receiver 252*a*, 252*b*.

Figures 3A, 3B, 3C:
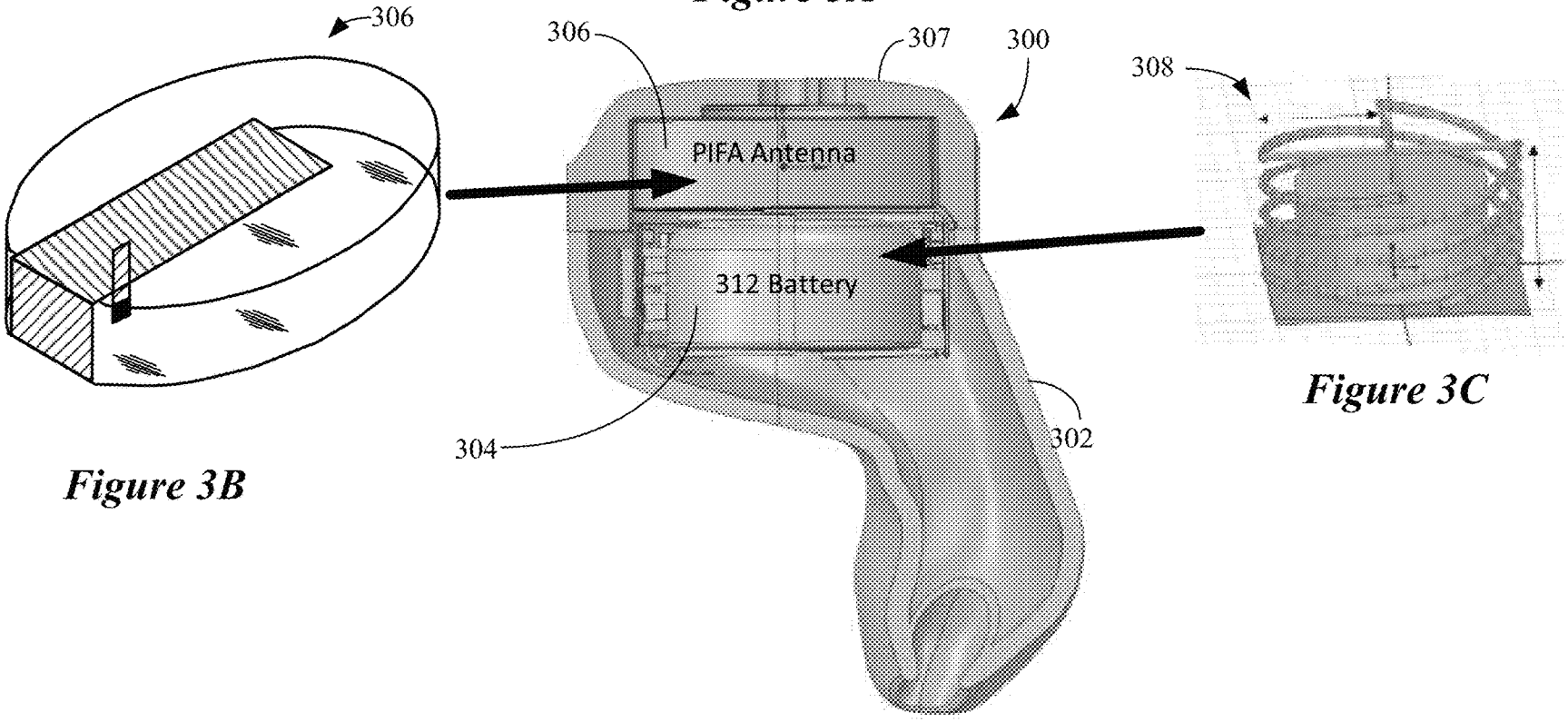
FIG. 3A shows a portion of a custom hearing device which incorporates a separate battery and a separate antenna in accordance with a conventional implementation.
FIG. 3B shows a conventional planar inverted-F antenna (PIFA) of a custom hearing device.
FIG. 3C shows an integrated battery/antenna module in accordance with any of the embodiments disclosed herein.

FIG. 3A illustrates a custom hearing aid 300 having a custom-shaped ITC shell 302 within which are housed a conventional arrangement of a separate battery 304 (e.g., a 312 battery) and a separate antenna 306, such as a PIFA shown in FIG. 3B. As is evident in FIG. 3A, the antenna 306 takes up an appreciable amount of space within the shell 302. The antenna 306 sits above the battery 304 and below a faceplate 307 of the hearing aid 300. In some implementations, the separate battery 304 and separate antenna 306 can have a total z-direction thickness in excess of 6.2 mm. According to various embodiments, the custom hearing aid 300 or other hearing device can effectively eliminate the space dedicated to a separate antenna 306 within the device housing 302 by incorporating an integrated battery/antenna module 308 of the present disclosure, such as that shown in FIG. 3C.

Because the helical antenna is wrapped around the battery, the battery/antenna module 308 can occupy about the same space allocated for the battery 304 alone. In various embodiments, the helical antenna can have a diameter from about 8 to 10 mm and a height from about 4 to 6 mm. For example, and in accordance with some embodiments, the battery/antenna module 308 can have a total z-direction thickness (height) of about 5 mm. The battery/antenna module 308 can have a radius of about 5 mm (diameter of 10 mm). Given that space is very limited in a custom form factor device, incorporating the battery/antenna module 308 in a custom or other small form factor device provides for a significant reduction in the overall size of the device.

In various embodiments, the antenna of an integrated battery/antenna module can be implemented in accordance with electrically small antenna theory. An antenna is considered to be an electrically small antenna as a function of its occupied volume or overall size relative to the wavelength of a signal or band of signals the antenna is intended to receive and/or transmit. An electrically small antenna is one that $ka<0.5$, where k is the free space wavenumber ($2\pi/\lambda$), and a is the radius of an imaginary sphere which circumscribes its maximum dimensions. As the antenna size decreases, undesired strong coupling effects occur. These include, but are not limited to, a narrow bandwidth or high Q, poor impedance matching, low radiation efficiency, etc.

It is known that any electrically small antenna can be tuned to be impedance matched at a single frequency using an external matching network with reactive components. However, one challenge is that the loss resistance in the matching components may decrease the overall efficiency. The antenna can be self-tuned to be impedance matched using a number of techniques, which is often more efficient than using an external matching network. This also reduces the costs of the matching components.

Another challenge is optimizing the antenna bandwidth as well as the radiation efficiency. It has been found that the lower bound of the Q is determined by the antenna radiation efficiency and its overall size relative to the wavelength. That is, the Q is proportional to the radiation efficiency and inversely proportional to ka, according to the Wheeler-Chu limit theory. As is well understood, the Q and matched bandwidth are inversely related. Therefore, the bandwidth of the antenna will not be greater than the predicted inverse Q, the fundamental limit. In other words, no electrically small antenna will have a Q that is less than the lower bound.

In accordance with some embodiments, the antenna of an integrated battery/antenna module is implemented as a helical wire antenna based on electrically small antenna theory. According to electrically small antenna theory, the optimized bandwidth of an antenna is determined by the antenna radiation efficiency and its size to the wavelength. The relationship between the bandwidth B, wavenumber k, size a, and radiation efficiency $\eta$ is as follows:

$$\frac{1}{B} \propto \left(\eta * \frac{1}{ka}\right) \Longrightarrow (B*\eta) \propto ka$$

Therefore, at a certain operating frequency, the size of the antenna can only be reduced at the expense of the bandwidth or efficiency. In general, the best antenna performance can be achieved if the geometry aspect ratio is close to unity, and if the fields inside the antenna fill the minimum size which encloses the sphere with the greatest uniformity possible.

According to electrically small antenna theory, for a PIFA such as that shown in FIG. 3B, the maximum dimension of the PIFA is 9.95 mm in the context of the custom ITC hearing aid shown in FIG. 3A. Therefore, a 5 mm. However, the PIFA shape only occupies a limited portion of the imaginary sphere with radius of 5 mm. The PIFA does not utilize the whole imaginary sphere volume. Thus, the bandwidth of the PIFA is narrower than the fundamental limit. Also, the PIFA uses a high dielectric material as the substrate, which degrades the radiation efficiency. This is also a reason why a patch antenna usually has lower efficiency than a wire antenna. The helical antenna of an integrated battery/antenna module 308, however, attempts to occupy the battery module (cylinder) volume as much as possible. The helical antenna uses a low dielectric substrate as the holding structure, which can be made relatively thin so the efficiency will not degrade significantly from the dielectric loss. The helical antenna can be designed to approach the electrically small antenna limit, that is, by utilizing the whole volume of the battery, to gain a relative wider bandwidth, lower Q, and higher radiation efficiency. At the same time, the helical antenna can be self-resonant around 2.5 GHz, and requires no or only minimal impedance matching effort for operation in the Bluetooth® frequency band.

Figure 4A:
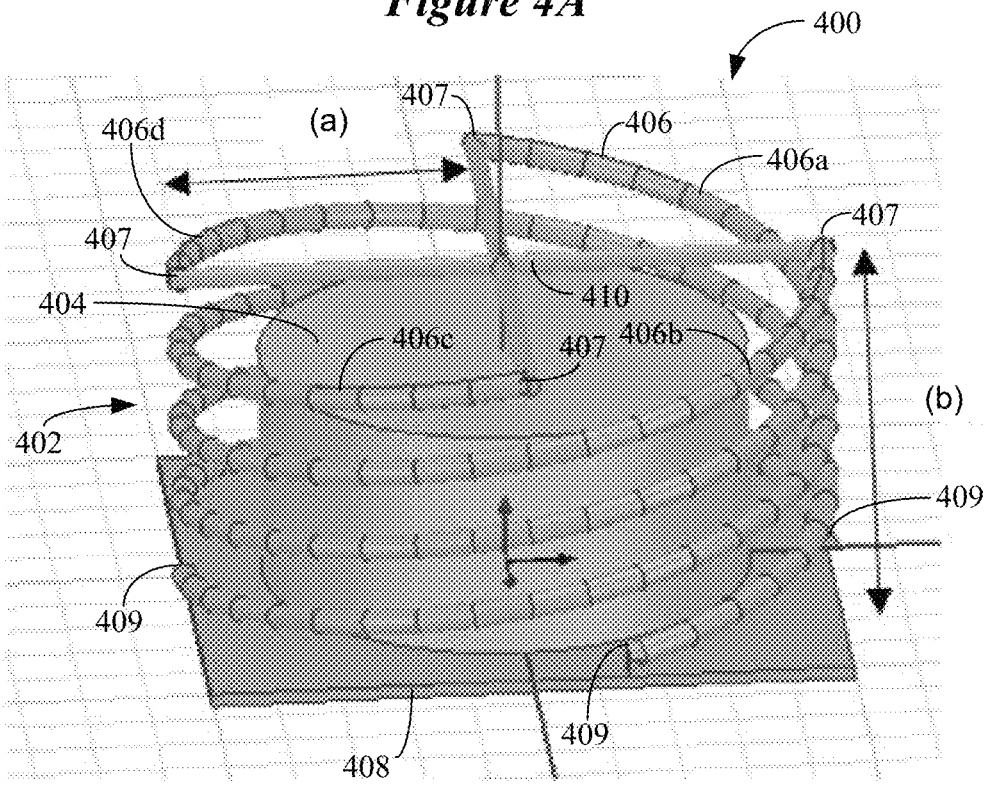
FIGS. 4A and 4B show an integrated battery/antenna module comprising a helical antenna in accordance with any of the embodiments disclosed herein.
Figure 4B:
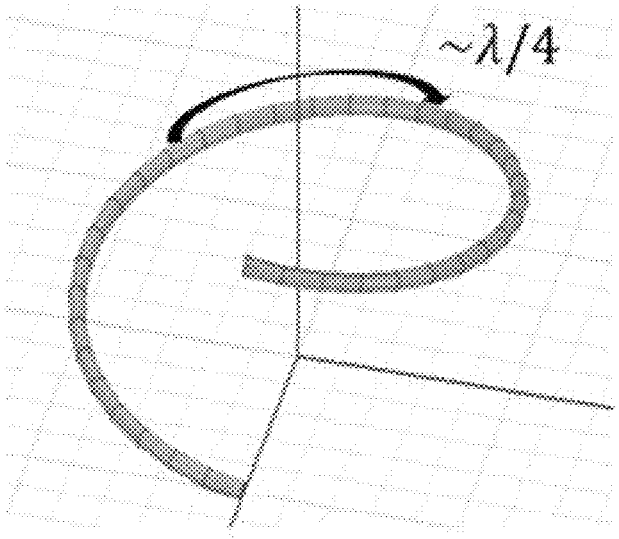

FIGS. 4A and 4B show an integrated battery/antenna module comprising a helical antenna in accordance with any of the embodiments disclosed herein. The antenna of the battery/antenna module can be implemented in accordance with electrically small antenna theory. The battery/antenna module 400 shown on FIG. 4A includes a helical antenna 402 wrapped around a battery 404. The helical antenna 402 includes a ground plane 408 and a radiating arm arrangement 406. The battery 404 is situated on the ground plane 408. Although not shown in FIG. 4A, electrically insulating material is disposed between the battery 404 and the helical antenna 402 (see, e.g., FIGS. 5A, 5B, and 6). For example, electrically insulating material is disposed between the battery 404 and the radiating arm arrangement 406, and between the battery 404 and the ground plane 408.

The radiating arm arrangement 406 shown in FIG. 4A includes a plurality of radiating arms that collectively wrap around the battery 404 in a spiral configuration. In the embodiment shown in FIG. 4A, the radiating arm arrangement 406 includes four radiating arms 406*a*-406*d*. Each of the radiating arms 406*a*-406*d* has a first end 407 and an opposing second end 409. The first ends 407 of the radiating arms 406*a*-406*d* are electrically connected together, such as by use of a radiating arm connector 410 situated above the battery 404. The second ends 409 of at least some of the radiating arms 406*a*-406*d* (e.g., three of the four radiating arms) are electrically coupled to the ground plane 408. The second end 409 of at least one of the radiating arms 406*a*-406*d* (e.g., one of the four radiating arms) is connected to a feed line, which is coupled to a radio frequency transceiver of the hearing device.

The radiating arms 406*a*-406*d* are radially offset from one another. For example, the four radiating arms 406*a*-406*d* are radially offset from one another by 90 degrees. More particularly, radiating arm 406*b* is radially offset from radiating arm 406*a* by 90 degrees. Radiating arm 406*c* is radially offset from radiating arm 406*b* by 90 degrees. Radiating arm 406*d* is radially offset from radiating arm 406*c* by 90 degrees. As is shown in FIG. 4B, each of the radiating arms 406*a*-406*d* preferably has a length electrically equivalent to about a quarter of a wavelength of a signal having a frequency falling within a specified frequency band, such as a Bluetooth® band. Provision of radiating arms 406*a*-406*d* having a length electrically equivalent to about a quarter of the wavelength facilitates the implementation of a self-resonant (self-matched) helical antenna 402, in which the inductive reactance and the capacitive reactance of the helical antenna 402 are cancelled without the need of a matching network.

The radiating arm arrangement 406 shown in FIG. 4A includes four radiating arms 406*a*-406*d* that collectively wrap around the battery 404 in a spiral configuration. It is understood that a radiating arm arrangement of the present disclosure can include more or fewer than four radiating arms. For example, a radiating arm arrangement according to any of the embodiments disclosed herein can incorporate N radiating arms, where N can equal one, two, three, four, five, six, seven or eight radiating arms, for example.

As discussed previously, the largest component in a hearing device, such as a custom hearing device, is typically the battery. A 312 hearing aid battery, for example, has a quasi-cylindrical shape with a radius dimension of 3.8 mm and a height dimension of 3.6 mm. The space in the hearing device allocated for the battery can instead be used to accommodate an integrated battery/antenna module, particularly in view of its unique cylinder-liked shape. In the context of electrically small antenna theory, and with reference again to FIG. 4A, an imaginary cylinder can be made to accommodate the battery, though the imaginary sphere is an ideal one. The helical antenna 402 of the battery/antenna module 400 shown in FIG. 4A can be designed from a single radiating arm 406*a*, one turn helix wire first, which is shown in FIG. 4B. The helix wire 406*a* can be considered a meandered wire monopole. The radius (e.g., a=5 mm, with a ranging from ~4 mm to ~6 mm) of the helix wire 406*a* is preferably the same as the pitch (e.g., b=5 mm, with b ranging from ~4 mm to ~6 mm), to obtain the largest circumscribing cylinder as possible. The total helix wire length is approximately a quarter wavelength, as previously discussed. The helical antenna 402 is then folded by three other arms 406*b,c,d*, each of which is radially offset by 90 degrees of separation. The top of the helical wire arrangement 406 is connected as a crisscross section via radiating arm connector 410. The folded technique provides for a helical antenna 402 which is self-matched at the resonant frequency. The helical antenna 402 and encompassed battery 404 are placed on a 5 mm×5 mm ground plane 408 in this illustrative example. In some embodiments, the feed can be located at the bottom of one radiating arm, while the other three radiating arms are connected to the ground plane 408. As was discussed previously, an electrically insulating material is disposed between the battery 404 and the helical antenna 402.

Figure 5A:
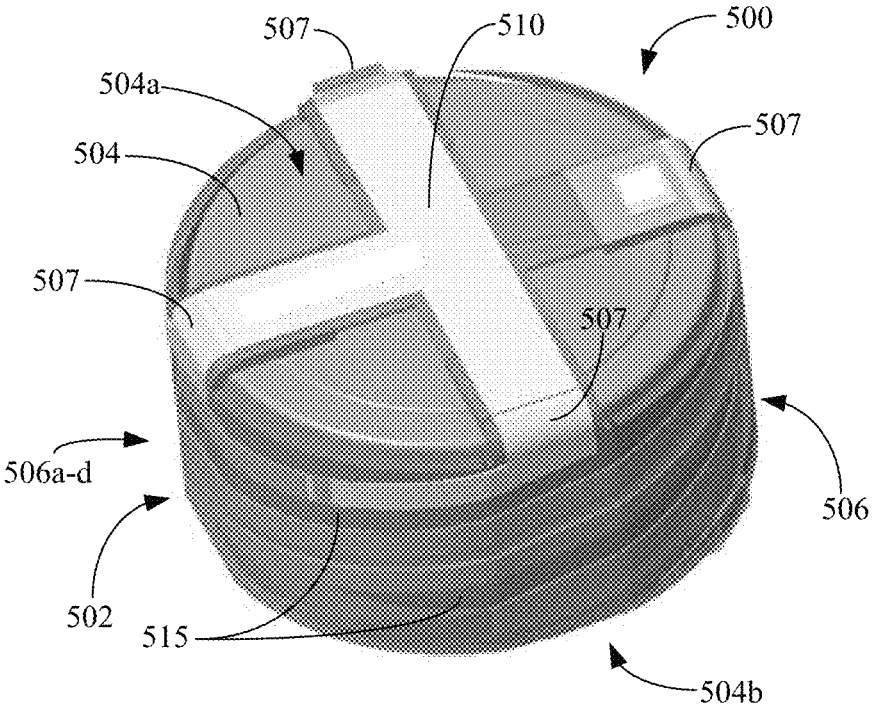
FIGS. 5A and 5B show an integrated battery/antenna module comprising a helical antenna in accordance with any of the embodiments disclosed herein.
Figure 5B:
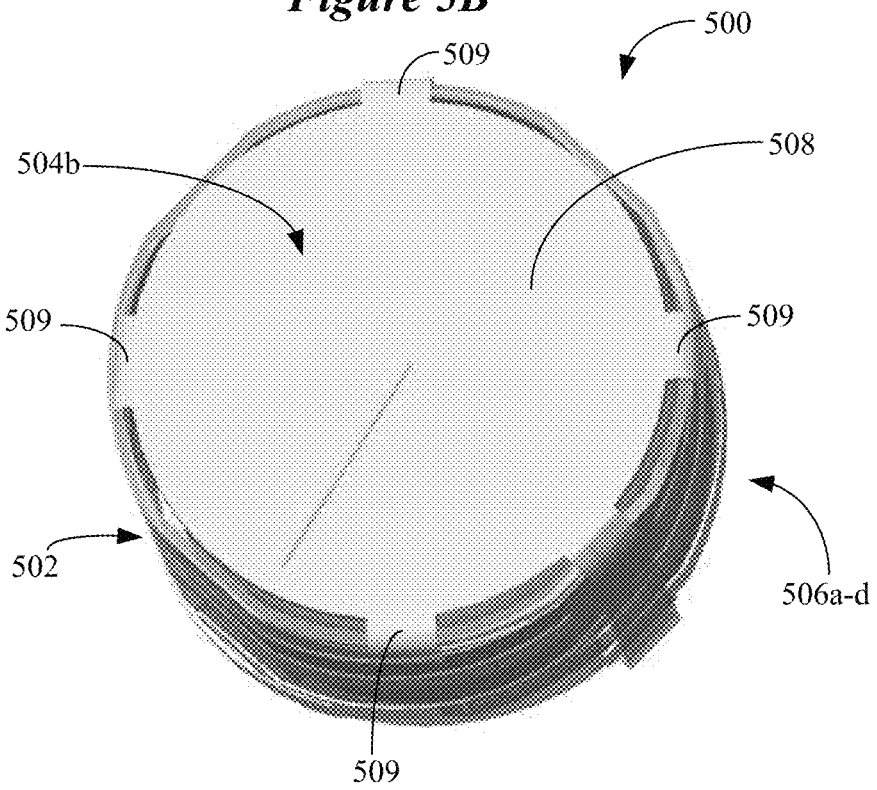

FIGS. 5A and 5B show an integrated battery/antenna module comprising a helical antenna in accordance with any of the embodiments disclosed herein. FIGS. 5A and 5B are top and bottom perspective views of a battery/antenna module 500, respectively. The battery/antenna module 500 includes a helical antenna 502 wrapped around a battery 504. Wrapping the helical antenna 502 around the battery 504 to form an integrated battery/antenna module 500 makes the antenna 502 much more mechanically robust and stable compared to conventional wire and flexible antennas incorporated in hearing devices.

In the embodiment shown in FIGS. 5A and 5B, the battery 504 has a sidewall having a generally cylindrical shape enclosed by top and bottom planar end surfaces 504*a*, 504*b*. It is understood that the battery 504 may have a different shape or cross-section, such as a substantially oval, square or rectangular shape or cross-section. In some embodiments, the antenna 502 can have a shape that conforms to the battery shape, such as by having wires or traces forming a meandered, oval, square, rectangular, spherical, or conical shape (or any combination of these shapes). Electrically insulating material 515 is disposed between the battery 504 and the helical antenna 502. All or a portion of the battery 504 can be encased in plastic, a ceramic-based high dielectric constant material, or other electrically insulating material 515. The electrically insulating material 515 can conform to the shape of the battery 504 or have a shape differing from that of the battery 504. For example, the electrically insulating material 515 can have a shape that dictates the shape of the antenna 502, irrespective of the shape of the battery 504.

In some embodiments, the electrically insulating material 515 forms a cap or sleeve which covers all or a portion of the battery 504. The cap or sleeve can be a 3D-printed structure, and the printing material can be VisiJet M3 Crystal material available from 3D Systems, Inc. At a minimum, electrically insulating material 515 is disposed between electrically conductive surfaces of the battery 504 and electrically conductive surfaces of the helical antenna 502.

The helical antenna 502 includes a ground plane 508 adjacent the bottom planar end surface 504*b* of the battery 504, a radiating arm connector 510 (e.g., crisscross section) adjacent the top planar end surface 504*a* of the battery 504, and a radiating arm arrangement 506 extending between the ground plane 508 and the radiating arm connector 510. The radiating arm arrangement 506 includes a plurality of radiating arms that wrap around the battery 504 in a spiral configuration. As shown, the radiating arm arrangement 506 includes four radiating arms 506*a*-506*d*. Each of the radiating arms 506*a*-506*d* has a first end 507 and an opposing second end 509. The first ends 507 of the radiating arms 506*a*-506*d* are electrically connected together by the radiating arm connector 510. The second ends 509 of at least some (e.g., three) of the radiating arms 506 *a*-506*d* are electrically coupled to the ground plane 508. The second end 509 of at least one of the radiating arms 506 *a*-506*d* is configured to be electrically coupled to a feed line of a radio transceiver.

Figure 6:
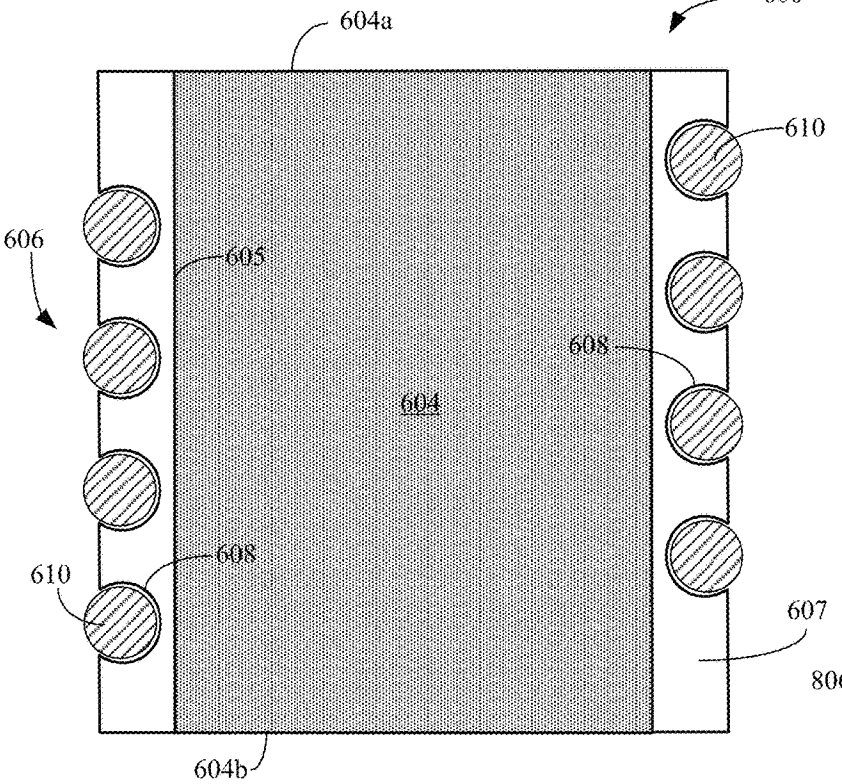
FIG. 6 shows a cross-section of a battery/antenna module incorporating a helical wire antenna in accordance with any of the embodiments disclosed herein.

In some embodiments, an integrated battery/antenna module can incorporate a helical wire antenna. FIG. 6 shows a cross-section of a battery/antenna module 600 incorporating a helical wire antenna 606 in accordance with any of the embodiments disclosed herein. The battery/antenna module 600 includes a battery 600 having a top planar surface 604*a*, an opposing bottom planar surface 604*b*, and a sidewall 605. The battery 604 has a generally cylindrical shape, but can have other shapes as previously described. Disposed on the sidewall 605 of the battery 604 is electrically insulating material 607. In some embodiments, the electrically insulating material 607 represents a pre-fabricated cap which covers at least the sidewall 605 of the battery 604. Typically, electrically insulating material 607 (e.g., the cap) also covers the top and bottom planar surfaces 604*a*, 604*b* (see, e.g., FIGS. 5A and 5B).

Figure 7:
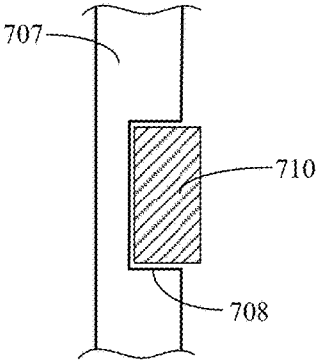
FIG. 7 is a cross-sectional view of an antenna support arrangement of an integrated battery/antenna module in accordance with any of the embodiments disclosed herein.

According to various embodiments, the electrically insulating material 607 defines a cap configured to support the helical wire antenna 606. More particularly, the cap 607 includes a support arrangement configured to receive and capture one or more wires 610 of the helical wire antenna 606. The cap 607 can include individual threads 608 (e.g., grooves, channels) configured for receiving and capturing individual wires 610 of the helical wire antenna 606. For example, the cap 607 can include four separate threads 608 configured to receive and capture four individual wires 610 of the helical wire antenna 606. In the embodiment shown in FIG. 6, the cap 607 incorporates C-shaped grooves 608 configured to receive and capture round wires 610. It is understood that different shapes and/or cross-sections of the grooves 608 and wires 610 are contemplated. For example, and with reference to FIG. 7, electrically insulating material 707 (e.g., formed as a cap) covering a battery can incorporate a polygonal-shaped (e.g., rectangle or square) thread, grooves or channel 708 configured to receive a polygonal-shaped (e.g., rectangle or square) wire 710.

Figure 8:
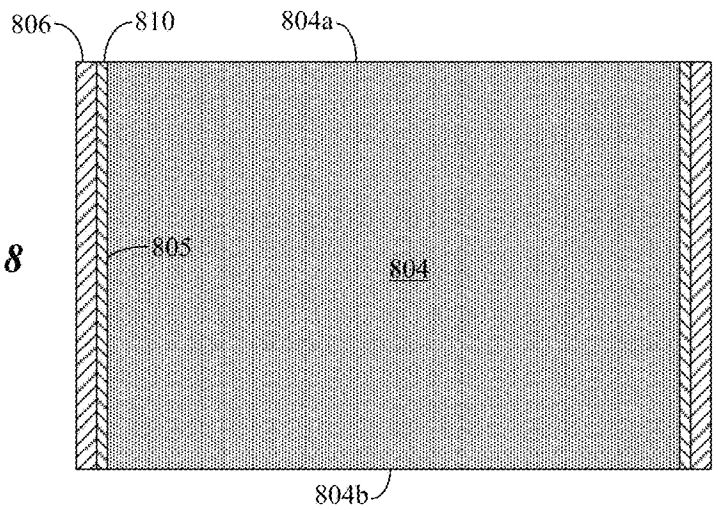
FIG. 8 shows a cross-section of a battery/antenna module incorporating a flexible printed wire antenna in accordance with any of the embodiments disclosed herein.

In accordance with other embodiments, an integrated battery/antenna module can incorporate a flexible printed wire antenna. FIG. 8 shows a cross-section of a battery/antenna module 800 incorporating a flexible printed wire antenna 806 wrapped around a sidewall 805 of a battery 804. The flexible printed wire antenna 806 is shown mounted to the sidewall 805 of the battery 804 via an adhesive 810. The flexible printed wire antenna 806 can incorporate an electrically conductive trace pattern encased in electrically insulating material. The trace pattern can include one or multiple traces (e.g., four traces) that form a helical trace configuration (see, e.g., FIGS. 4A-4B and 5A-5B). For example, the flexible printed wire antenna 806 can be implemented as a multiple-layer structure comprising a plurality of printed conductive traces (e.g., copper) encased by electrically insulating films, such as polyimide or polyester films.

In the embodiment shown in FIG. 8, the battery 804 need not be covered by electrically insulating material since the flexible printed wire antenna 806 includes at least one layer of electrically insulating material as an outer protective film. Although not shown in FIG. 8, the flexible printed wire antenna 806 can incorporate a ground plane, which can be situated adjacent a bottom planar end surface 804*b* of the battery 804, and further incorporate a trace connector arrangement (e.g., a crisscross connector) situated adjacent a top planar end surface 804*a* of the battery 804. The flexible printed wire antenna 806 can include one or a number of conductive traces (e.g., four traces) which are electrically connected to the ground plane, connector arrangement, and feedline in a manner previously described.

Figure 9:
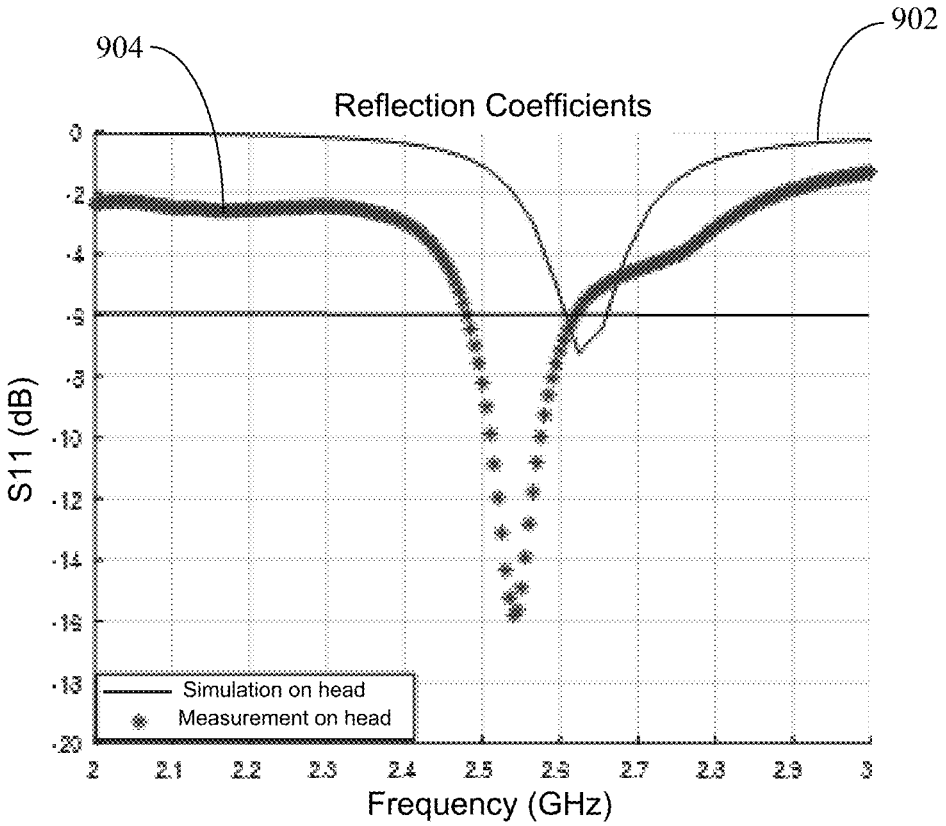
FIG. 9 shows reflection coefficient (S11) vs. frequency plots for simulated and prototype helical antennas of battery/antenna modules in accordance with any of the embodiments disclosed herein.

Simulations were performed on a homogenous phantom head using a battery/antenna module having a helical antenna. The battery/antenna module (a helical antenna with battery inserted within the antenna) was placed in the phantom's ear canal. The phantom is filled with effective muscle tissue with a relative dielectric constant of $\varepsilon_r$=35.4, and an electrical conductivity of $\sigma$=1.81 siemens/m. The simulated antenna reflection coefficient (S11) vs. frequency is plotted as curve 902 in FIG. 9. As shown in FIG. 9, the antenna resonant frequency is shifted to the higher range of the Bluetooth® band (around 2.65 GHz) in the simulations. This is due to the stainless steel 312 battery introducing more capacitance in the antenna. Also, the ground plane size is small in the simulation, compared to the ideal infinitely large ground plane case. The result, however, is very encouraging because S11 can get much lower than −6 dB. The −3-dB bandwidth is 140 MHz, which is wide enough to cover the Bluetooth® 2.4 GHz frequency range.

FIG. 9 also shows S11 vs. frequency plotted as curve 904 derived from on-head measurement using a prototype battery/antenna module having a helical antenna. The prototype battery/antenna module comprised a helical antenna placed in an ITE shell, with a 312-dummy battery placed inside the antenna. A flexible circuit and receiver were placed inside the shell near the helical antenna to mimic the entire system. The antenna input impedance was measured using a Keysight N5230C Vector Network Analyzer.

The measured S11 vs. frequency results are plotted as curve 904 in FIG. 9. It can be seen that the helical antenna achieves a very good impedance match around 2.54 GHz. The −6-dB bandwidth is 140 MHz (2.48 GHz-2.62 GHz). A similar measurement was performed on a PIFA (see, e.g., FIG. 3B) within an ITE shell on a phantom head. The PIFA demonstrated a poor impedance match over the entire Bluetooth® frequency band. The lowest S11 for the PIFA was −2.56 dB at 2.32 GHz, which would require a significant impedance matching effort at the desired frequency band. The helical antenna, in contrast, requires no or only minimal matching effort since it has a wide bandwidth around 2.54 GHz.

Total radiated power (TRP) measurements were obtained for the helical and PIFA antennas. Both the helical antenna (encompassing the 312-dummy battery) and PIFA were placed in an ITE shell (and connected to a flexible circuit for making the measurements) on the left ear of the phantom head and a human subject, respectively. The TRP measurement results demonstrate that the helical antenna has comparable performance with the PIFA. It is noted that the PIFA was tuned under the active circuit environment, with an external matching network. The helical antenna, in contrast, did not have any external matching network and was directly connected to the flexible circuit. Since the helical antenna was not fully optimized under the active environment (e.g., with radio, filter, transmission line etc.), the helical antenna it is expected to have a higher TRP once it is tuned with the circuit. Given the construction of the helical antenna under evaluation, the helical antenna achieved a good result, comparable to that of the tuned PIFA.

Figure 10B:
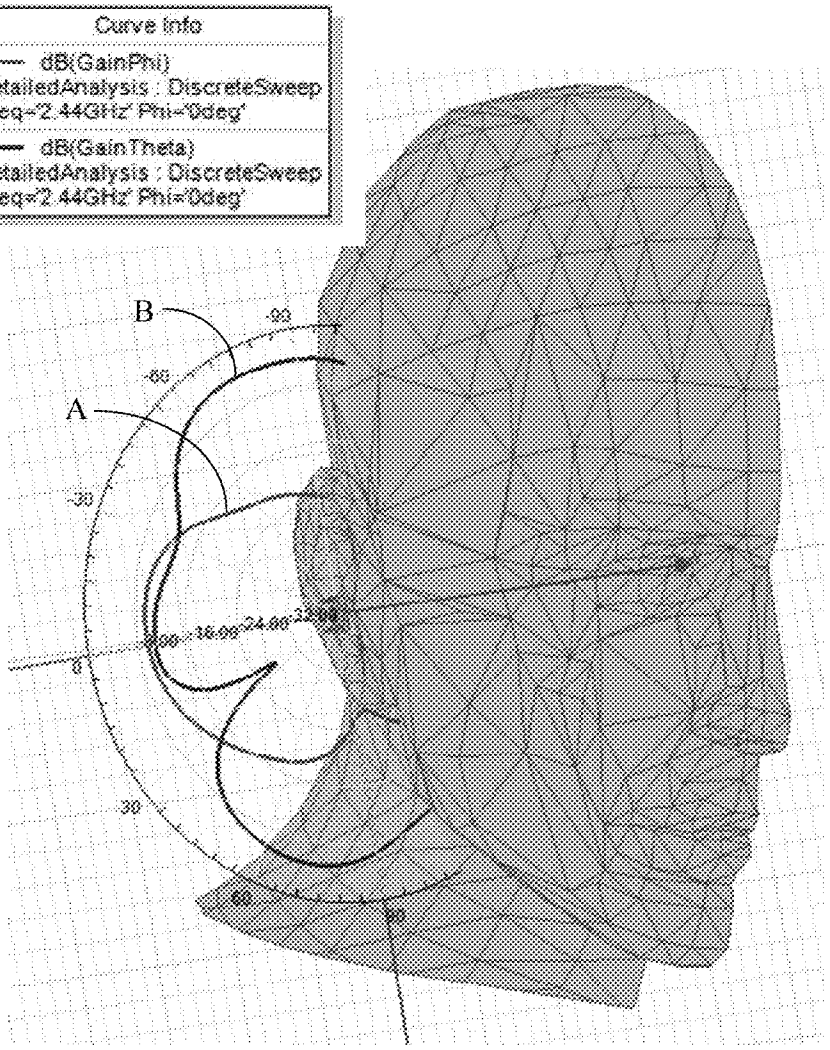
FIGS. 10A and 10B show the radiation pattern of a helical antenna of a battery/antenna module disposed on a wearer's head when operating at 2.44 GHz in accordance with any of the embodiments disclosed herein.
Figure 10A:
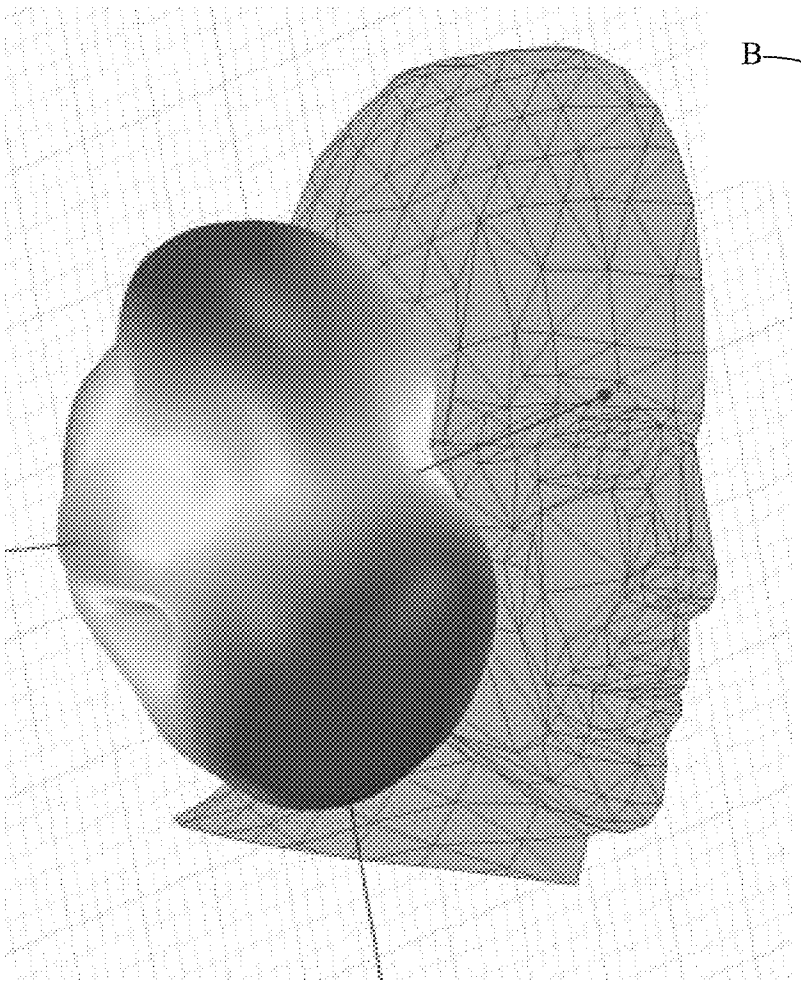

FIGS. 10A and 10B show the radiation pattern of the helical antenna positioned on the head and operating at 2.44 GHz. In FIG. 10A, the darker coloring indicates stronger electric field strength. It was found that the helical antenna is mainly vertically polarized when placed on the head. More specifically, the helical antenna generates an electric field having a direction of propagation substantially parallel around the wearer's head, and generates an electric field polarization substantially normal to the wearer's head. This is particularly beneficial to establishing an ear-to-ear communication link, since the vertically polarized antenna couples the creeping wave much more efficiently. The peak directivity at 2.44 GHz was 4.458 dB and radiation efficiency was −6.96 dB. The radiation efficiency is high compared to other 2.4 GHz custom hearing device antennas.

The specific configuration of a helical antenna of the present disclosure is generally dependent on a number of factors, including the space available in a particular ear-worn electronic device, the particular antenna performance requirements, and the size/shape of the battery which is encompassed by the helical antenna. Due to the performance benefit and small size, an integrated battery/antenna module of the present disclosure can be incorporated in devices beyond ear-worn electronic devices where device size significantly limits antenna size. Other devices (e.g., body-worn electronic devices) that can incorporate an integrated battery/antenna module of the present disclosure include, but are not limited to, fitness and/or health monitoring watches or other wrist worn or hand-held objects, e.g., Apple Watch®, Fitbit®, cell phones, smartphones, handheld radios, medical implants, hearing aid accessories, wireless capable helmets (e.g., used in professional football), and wireless headsets/headphones (e.g., virtual reality headsets). Each of these devices is represented by the system block diagram of FIG. 1A or 1B, with the components of FIGS. 1A and 1B varying depending on the particular device implementation.

This document discloses numerous embodiments, including but not limited to the following:

Item 1 is an ear-worn electronic device configured to be worn by a wearer, comprising:

a housing configured to be supported at, by, in or on the wearer's ear, a processor disposed in the housing;

a speaker or a receiver operably coupled to the processor;

a radio frequency transceiver disposed in the housing and operably coupled to the processor; and a battery/antenna module disposed in the housing and comprising:

a battery;

a helical antenna wrapped around the battery and operably coupled to the transceiver; and electrically insulating material disposed between the helical antenna and the battery.

Item 2 is the device of item 1, wherein:

the helical antenna comprises a ground plane; and the battery is situated on the ground plane.

Item 3 is the device of item 1, wherein:

the electrically insulating material is configured as a cap at least partially covering the battery; and the cap comprises a support arrangement configured to support the helical antenna on the battery.

Item 4 is the device of item 3, wherein the support arrangement of the cap comprises a thread arrangement configured to retentively support the helical antenna.

Item 5 is the device of item 1, wherein:

the helical antenna comprises a flexible printed wire antenna affixed to the battery; and the electrically insulating material defines an electrically insulating layer of the flexible printed wire antenna.

Item 6 is the device of item 1, wherein the helical antenna comprises a plurality of radiating arms spaced apart from one another Item 7 is the device of item 6, wherein the radiating arms are radially offset from one another.

Item 8 is the device of item 6, wherein:

each of the radiating arms comprises a first end and a second end;

the first ends are electrically connected together;

at least some of the second ends are coupled to a ground plane of the helical antenna; and a second end of at least one of the radiating arms is coupled to a feed line of the helical antenna.

Item 9 is the device of item 1, wherein:

the helical antenna comprises four radiating arms radially offset from one another by 90 degrees; and each of the radiating arms has a length electrically equivalent to about a quarter of a wavelength of a signal having a frequency falling within a specified frequency band.

Item 10 is the device of item 1, wherein the helical antenna is self-resonant.

Item 11 is the device of item 1, wherein, when the device is positioned at, by, in or on the wearer's ear, the helical antenna is configured to:

generate an electric field having a direction of propagation substantially parallel to the wearer's head; and generate an electric field polarization substantially normal to the wearer's head.

Item 12 is the device of item 1, wherein the helical antenna and the transceiver are configured to operate within a 2.4 GHz ISM frequency band.

Item 13 is an ear-worn electronic device configured to be worn by a wearer, comprising:

a housing configured to be supported at, by, in or on the wearer's ear, a processor disposed in the housing;

a speaker or a receiver operably coupled to the processor;

a radio frequency transceiver disposed in the housing and operably coupled to the processor; and a battery/antenna module disposed in the housing and comprising:

a battery;

a helical antenna operably coupled to the transceiver and comprising a plurality of wires wrapped around the battery; and an electrically insulating cap disposed on the battery, the cap separating the wires from the battery and comprising a support arrangement configured support the wires in a fixed position relative to the battery.

Item 14 is the device of item 13, wherein:

the cap comprises a spiraling thread arrangement; and the wires are captured with the thread arrangement.

Item 15 is the device of item 13, wherein:

the helical antenna comprises a ground plane;

the battery is situated on the ground plane;

the wires are spaced apart and radially offset from one another, each of the wires comprises a first end and an opposing second end;

the first ends are electrically connected together;

at least some of the second ends are coupled to the ground plane; and a second end of at least one of the wires is coupled to a feed line of the helical antenna.

Item 16 is the device of item 13, wherein:

the helical antenna comprises four wires radially offset from one another by 90 degrees; and each of the wires has a length electrically equivalent to about a quarter of a wavelength of a signal having a frequency falling within a specified frequency band.

Item 17 is the device of item 13, wherein the helical antenna is self-resonant.

Item 18 is the device of item 13, wherein, when the device is positioned at, by, in or on the wearer's ear, the helical antenna is configured to:

generate an electric field having a direction of propagation substantially parallel to the wearer's head; and generate an electric field polarization substantially normal to the wearer's head.

Item 19 is an ear-worn electronic device configured to be worn by a wearer, comprising:

a housing configured for at least partial insertion into an ear canal of the wearer, the housing having a preformed shape that conforms to a shape of the wearer's ear canal;

a processor disposed in the housing;

a speaker or a receiver operably coupled to the processor;

a radio frequency transceiver disposed in the housing and operably coupled to the processor; and a battery/antenna module disposed in the housing and comprising:

a battery;

a helical antenna wrapped around the battery and operably coupled to the transceiver; and electrically insulating material disposed between the helical antenna and the battery.

Item 20 is the device of item 19, wherein the battery has a size substantially equivalent to that of a 312 hearing aid battery.

Item 21 is the device of item 19, wherein the helical antenna has a diameter from about 8 to 10 mm and a height from about 4 to 6 mm.

Item 22 is the device of item 19, wherein the ear-worn electronic device is configured as an in-the-ear (ITE) device, in-the-canal (ITC) device, invisible-in-canal (IIC) device or completely-in-the-canal (CIC) device.

Item 23 is the device of item 19, wherein:

the helical antenna comprises a plurality of wires and a ground plane;

the battery is situated on the ground plane;

the wires are spaced apart and radially offset from one another, each of the wires comprising a first end an opposing second end;

first ends of the wires are electrically connected together;

at least some of the second ends are coupled to the ground plane; and a second end of at least one of the wires is coupled to a feed line of the helical antenna.

Item 24 is an apparatus, comprising:

a battery/antenna module comprising:

a battery;

a helical antenna wrapped around the battery; and electrically insulating material disposed between the helical antenna and the battery.

Item 25 is the device of item 24, wherein:

the helical antenna comprises a ground plane; and the battery is situated on the ground plane.

Item 26 is the device of item 24, wherein:

the electrically insulating material is configured as a cap at least partially covering the battery; and the cap comprises a support arrangement configured to support the helical antenna on the battery.

Item 27 is the device of item 26, wherein the support arrangement of the cap comprises a thread arrangement configured to retentively support the helical antenna.

Item 28 is the device of item 24, wherein:

the helical antenna comprises a flexible printed wire antenna affixed to the battery; and the electrically insulating material defines an electrically insulating layer of the flexible printed wire antenna.

Item 29 is the device of item 24, wherein the helical antenna comprises a plurality of radiating arms spaced apart from one another Item 30 is the device of item 29, wherein the radiating arms are radially offset from one another.

Item 31 is the device of item 29, wherein:

each of the radiating arms comprises a first end and a second end;

the first ends are electrically connected together;

at least some of the second ends are coupled to a ground plane of the helical antenna; and a second end of at least one of the radiating arms is coupled to a feed line of the helical antenna.

Item 32 is the device of item 24, wherein:

the helical antenna comprises four radiating arms radially offset from one another by 90 degrees; and each of the radiating arms has a length electrically equivalent to about a quarter of a wavelength of a signal having a frequency falling within a specified frequency band.

Item 33 is the device of item 24, wherein the helical antenna is self-resonant.

Item 34 is the device of item 24, wherein the helical antenna is configured to operate within a 2.4 GHz ISM frequency band.

Although reference is made herein to the accompanying set of drawings that form part of this disclosure, one of at least ordinary skill in the art will appreciate that various adaptations and modifications of the embodiments described herein are within, or do not depart from, the scope of this disclosure. For example, aspects of the embodiments described herein may be combined in a variety of ways with each other. Therefore, it is to be understood that, within the scope of the appended claims, the claimed invention may be practiced other than as explicitly described herein.

All references and publications cited herein are expressly incorporated herein by reference in their entirety into this disclosure, except to the extent they may directly contradict this disclosure. Unless otherwise indicated, all numbers expressing feature sizes, amounts, and physical properties used in the specification and claims may be understood as being modified either by the term "exactly" or "about." Accordingly, unless indicated to the contrary, the numerical parameters set forth in the foregoing specification and attached claims are approximations that can vary depending upon the desired properties sought to be obtained by those skilled in the art utilizing the teachings disclosed herein or, for example, within typical ranges of experimental error.

The recitation of numerical ranges by endpoints includes all numbers subsumed within that range (e.g. 1 to 5 includes 1, 1.5, 2, 2.75, 3, 3.80, 4, and 5) and any range within that range. Herein, the terms "up to" or "no greater than" a number (e.g., up to 50) includes the number (e.g., 50), and the term "no less than" a number (e.g., no less than 5) includes the number (e.g., 5).

The terms "coupled" or "connected" refer to elements being attached to each other either directly (in direct contact with each other) or indirectly (having one or more elements between and attaching the two elements). Either term may be modified by "operatively" and "operably," which may be used interchangeably, to describe that the coupling or connection is configured to allow the components to interact to carry out at least some functionality (for example, a radio chip may be operably coupled to an antenna element to provide a radio frequency electromagnetic signal for wireless communication).

Terms related to orientation, such as "top," "bottom," "side," and "end," are used to describe relative positions of components and are not meant to limit the orientation of the embodiments contemplated. For example, an embodiment described as having a "top" and "bottom" also encompasses embodiments thereof rotated in various directions unless the content clearly dictates otherwise.

Reference to "one embodiment," "an embodiment," "certain embodiments," or "some embodiments," etc., means that a particular feature, configuration, composition, or characteristic described in connection with the embodiment is included in at least one embodiment of the disclosure. Thus, the appearances of such phrases in various places throughout are not necessarily referring to the same embodiment of the disclosure. Furthermore, the particular features, configurations, compositions, or characteristics may be combined in any suitable manner in one or more embodiments.

The words "preferred" and "preferably" refer to embodiments of the disclosure that may afford certain benefits, under certain circumstances. However, other embodiments may also be preferred, under the same or other circumstances. Furthermore, the recitation of one or more preferred embodiments does not imply that other embodiments are not useful and is not intended to exclude other embodiments from the scope of the disclosure.

As used in this specification and the appended claims, the singular forms "a," "an," and "the" encompass embodiments having plural referents, unless the content clearly dictates otherwise. As used in this specification and the appended claims, the term "or" is generally employed in its sense including "and/or" unless the content clearly dictates otherwise.

As used herein, "have," "having," "include," "including," "comprise," "comprising" or the like are used in their open-ended sense, and generally mean "including, but not limited to." It will be understood that "consisting essentially of," "consisting of" and the like are subsumed in "comprising," and the like. The term "and/or" means one or all of the listed elements or a combination of at least two of the listed elements.

The phrases "at least one of," "comprises at least one of," and "one or more of" followed by a list refers to any one of the items in the list and any combination of two or more items in the list.

What is claimed is:

1. An ear-worn electronic device configured to be worn by a wearer, comprising:
- a housing configured to be supported at, by, in or on the wearer's ear,
- a processor disposed in the housing;
- a speaker or a receiver operably coupled to the processor;
- a radio frequency transceiver disposed in the housing and operably coupled to the processor; and
- a battery/antenna module disposed in the housing and comprising:
  - a battery;
  - a helical antenna comprising a set of offset antenna elements wrapped around the battery and operably coupled to the transceiver; and
  - electrically insulating material disposed between the helical antenna and the battery.

2. The device of claim 1, wherein:
- the helical antenna comprises a ground plane; and
- the battery is situated on the ground plane.

3. The device of claim 1, wherein:
- the electrically insulating material is configured as a cap at least partially covering the battery; and
- the cap comprises a support arrangement configured to support the helical antenna on the battery.

4. The device of claim 3, wherein the support arrangement of the cap comprises a thread arrangement configured to retentively support the helical antenna.

5. The device of claim 1, wherein:
- the helical antenna comprises a flexible printed wire antenna affixed to the battery; and
- the electrically insulating material defines an electrically insulating layer of the flexible printed wire antenna.

6. The device of claim 1, wherein the set of offset antenna elements comprises a set of radiating arms spaced apart from one another.

7. The device of claim 6, wherein the radiating arms are radially offset from one another.

8. The device of claim 6, wherein:
- each of the radiating arms comprises a first end and a second end;
- the first ends are electrically connected together;
- at least some of the second ends are coupled to a ground plane of the helical antenna; and
- a second end of at least one of the radiating arms is coupled to a feed line of the helical antenna.

9. The device of claim 1, wherein:
- the set of offset antenna elements comprises four radiating arms radially offset from one another by 90 degrees; and
- each of the radiating arms has a length electrically equivalent to about a quarter of a wavelength of a signal having a frequency falling within a specified frequency band.

10. The device of claim 1, wherein the helical antenna is self-resonant.

11. The device of claim 1, wherein, when the device is positioned at, by, in or on the wearer's ear, the helical antenna is configured to:
- generate an electric field having a direction of propagation substantially parallel to the wearer's head; and
- generate an electric field polarization substantially normal to the wearer's head.

12. The device of claim 1, wherein the helical antenna and the transceiver are configured to operate within a 2.4 GHz ISM frequency band.

13. An ear-worn electronic device configured to be worn by a wearer, comprising:
- a housing configured to be supported at, by, in or on the wearer's ear,
- a processor disposed in the housing;
- a speaker or a receiver operably coupled to the processor;
- a radio frequency transceiver disposed in the housing and operably coupled to the processor; and
- a battery/antenna module disposed in the housing and comprising:
  - a battery;
  - a helical antenna operably coupled to the transceiver and comprising a set of offset wires wrapped around the battery; and
  - an electrically insulating cap disposed on the battery, the cap separating the wires from the battery and comprising a support arrangement configured support the wires in a fixed position relative to the battery.

14. The device of claim 13, wherein:
- the cap comprises a spiraling thread arrangement; and
- the wires are captured with the thread arrangement.

15. The device of claim 13, wherein:
- the helical antenna comprises a ground plane;
- the battery is situated on the ground plane;
- the wires are spaced apart and radially offset from one another, each of the wires comprises a first end and an opposing second end;
- the first ends are electrically connected together;
- at least some of the second ends are coupled to the ground plane; and
- a second end of at least one of the wires is coupled to a feed line of the helical antenna.

16. The device of claim 13, wherein:
- the helical antenna comprises four wires radially offset from one another by 90 degrees; and
- each of the wires has a length electrically equivalent to about a quarter of a wavelength of a signal having a frequency falling within a specified frequency band.

17. The device of claim 13, wherein the helical antenna is self-resonant.

18. The device of claim 13, wherein, when the device is positioned at, by, in or on the wearer's ear, the helical antenna is configured to:

generate an electric field having a direction of propagation substantially parallel to the wearer's head; and generate an electric field polarization substantially normal to the wearer's head.

19. An ear-worn electronic device configured to be worn by a wearer, comprising:

a housing configured for at least partial insertion into an ear canal of the wearer, the housing having a preformed shape that conforms to a shape of the wearer's ear canal;

a processor disposed in the housing;

a speaker or a receiver operably coupled to the processor;

a radio frequency transceiver disposed in the housing and operably coupled to the processor; and a battery/antenna module disposed in the housing and comprising:

a battery;

a helical antenna comprising a set of offset antenna elements wrapped around the battery and operably coupled to the transceiver; and electrically insulating material disposed between the helical antenna and the battery.

20. The device of claim 19, wherein the battery has a size substantially equivalent to that of a 312 hearing aid battery.

21. The device of claim 19, wherein the helical antenna has a diameter from about 8 to 10 mm and a height from about 4 to 6 mm.

22. The device of claim 19, wherein the ear-worn electronic device is configured as an in-the-ear (ITE) device, in-the-canal (ITC) device, invisible-in-canal (IIC) device or completely-in-the-canal (CIC) device.

23. The device of claim 19, wherein:

the helical antenna comprises a ground plane and the set of offset antenna elements comprises a set of wires;

the battery is situated on the ground plane;

the wires are spaced apart and radially offset from one another, each of the wires comprising a first end an opposing second end;

first ends of the wires are electrically connected together;

at least some of the second ends are coupled to the ground plane; and a second end of at least one of the wires is coupled to a feed line of the helical antenna.

* * * * *